US006092682A

United States Patent [19]

Weiler

[11] Patent Number: 6,092,682

[45] **Date of Patent: *Jul. 25, 2000**

[54] HERMETICALLY SEALED CONTAINER WITH CLOSURE INSERT

[75] Inventor: Gerhard H. Weiler, South Barrington, Ill.

[73] Assignee: Automatic Liquid Packaging, Inc., Woodstock, Ill.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/636,479

[22] Filed: Apr. 23, 1996

[51] Int. Cl.[7] ..... B65D 39/00; B65D 41/58

[52] U.S. Cl. ..... 215/47; 215/50; 215/249; 215/251; 215/256; 215/DIG. 3

[58] Field of Search ..... 215/251, DIG. 3, 215/211, 249, 246, 258, 296, 299, 305, 355, 40, 43, 48, 50, 253, 356, 357, 256, 47

[56] References Cited

U.S. PATENT DOCUMENTS

| | | | |
|---|---|---|---|
| 3,124,273 | 3/1964 | Remington et al. | 215/43 |
| 3,191,790 | 6/1965 | Coven et al. | 215/251 |
| 3,905,368 | 9/1975 | Lewis, Jr. et al. | 215/251 X |
| 4,226,334 | 10/1980 | Weiler et al. . | |
| 4,512,486 | 4/1985 | Kobayashi et al. | 215/251 X |
| 4,519,513 | 5/1985 | Weiler et al. . | |
| 4,523,691 | 6/1985 | Larkin et al. | 215/251 X |
| 4,569,456 | 2/1986 | Weiler et al. | 215/251 |
| 4,596,110 | 6/1986 | Weiler . | |
| 4,821,897 | 4/1989 | Weiler | 215/251 X |
| 4,886,497 | 12/1989 | Scholl, Jr. | 215/252 X |
| 4,901,873 | 2/1990 | Weiler | 215/251 X |
| 4,982,769 | 1/1991 | Fournier et al. | 215/DIG. 3 X |
| 5,114,030 | 5/1992 | Conard | 215/251 X |
| 5,595,314 | 1/1997 | Weiler | 215/247 |
| 5,649,637 | 7/1997 | Weiler | 215/251 |
| 5,718,346 | 2/1998 | Weiler | 215/251 |
| 5,740,931 | 4/1998 | Weiler | 215/251 |

*Primary Examiner*—Allan N. Shoap
*Assistant Examiner*—Niki M. Eloshway
*Attorney, Agent, or Firm*—Olson & Hierl, Ltd.

[57] ABSTRACT

A flanged closure insert is provided for the socket of a hermetically sealed thermoplastic container. The closure insert has an outwardly extending peripheral flange that facilitates sealing of the container. The thermoplastic material of the container may be welded to the flange for an enhanced seal.

18 Claims, 4 Drawing Sheets

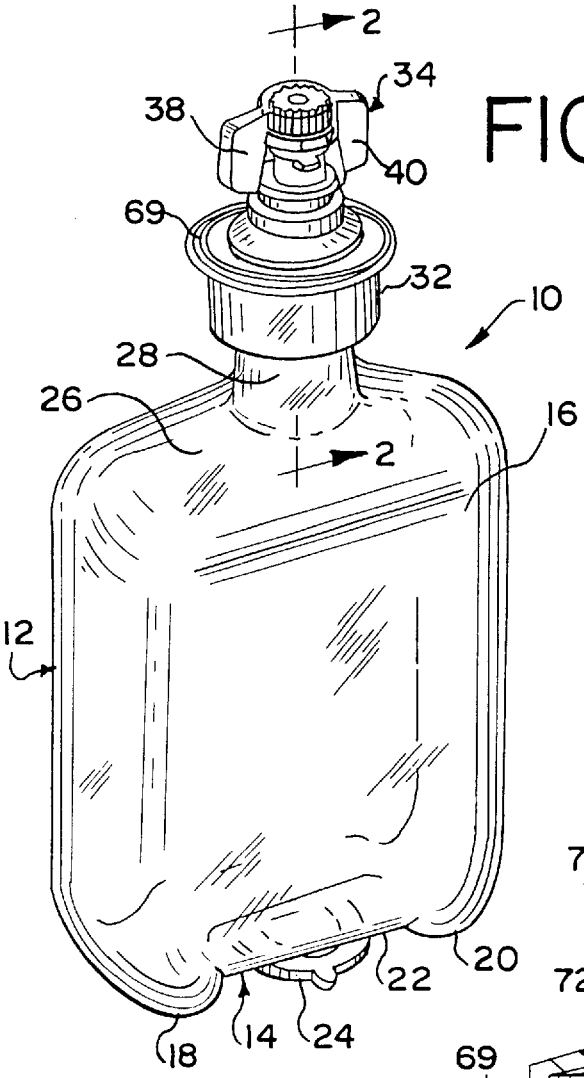
FIG. 1
FIG. 2
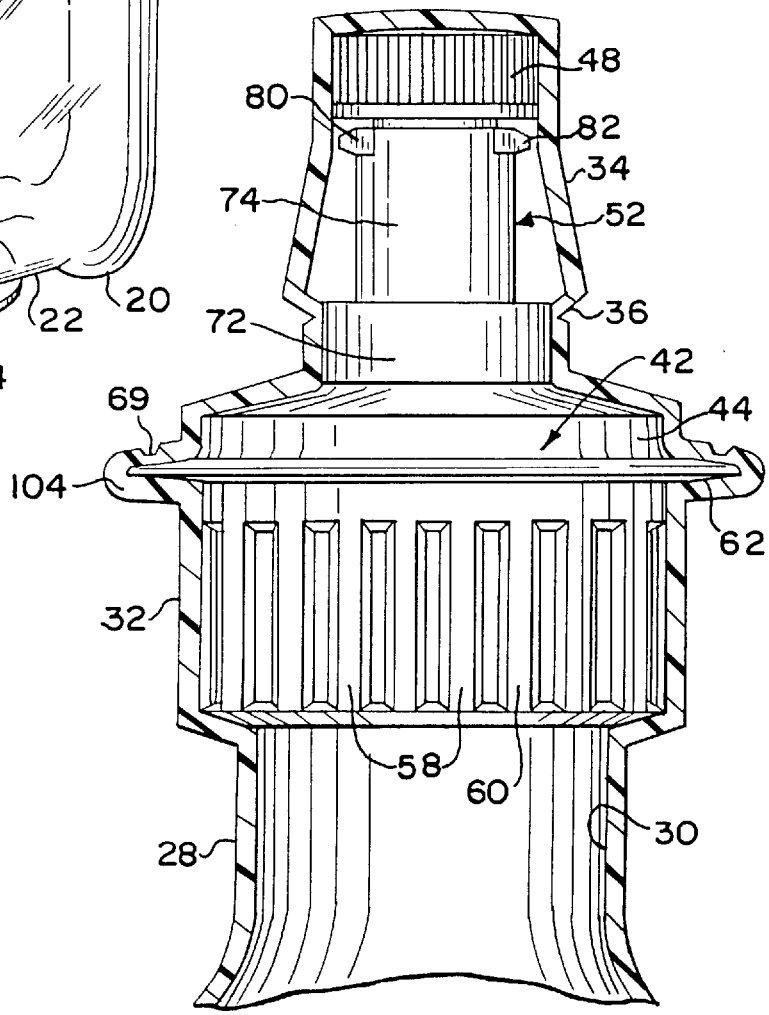

HERMETICALLY SEALED CONTAINER WITH CLOSURE INSERT

FIELD OF THE INVENTION

This invention relates to a hermetically sealed container and, more particularly, to a closure insert for the cap portion of a hermetically sealed, container.

BACKGROUND OF THE INVENTION

Hermetically sealed containers can be readily produced by the so-called blow/fill/seal techniques. Utilizing such techniques, a container body is first blow molded from an extruded parison segment, then charged (or filled) with a desired liquid or solid contents, and thereafter immediately sealed by a preformed closure insert while additionally molding the parison segment at the container socket about the inserted, preformed closure insert. See, for example, the container structure disclosed in U.S. Pat. No. 4,596,110 to Weiler.

The hermetically sealed container structures that result from such a blow, fill and seal container molding procedure, especially those with a removable closure shroud as disclosed in U.S. Pat. No. 4,596,110 to Weiler, are very useful and have come into widespread usage. However, under certain conditions of relatively extreme usage, the preformed closure insert can become disengaged or loosened from its engagement with the thermoplastic material forming the container skirt. Such disengagement not only raises the risk of environmental contamination of the container contents, but also can cause leaking of the container contents between the closure insert and the thermoplastic material forming the container socket.

It would thus be desirable to provide a practical means for overcoming a potential loosening and leaking problem. The present invention provides a practical solution to this problem.

SUMMARY OF THE INVENTION

The present invention contemplates a preformed closure insert permanently received in a socket provided in a hermetically sealed container formed from a thermoplastic material. The closure insert is provided about the perimeter thereof with an outwardly extending peripheral flange that provides increased sealing contact area between the closure insert and the thermoplastic material of the container socket in contact therewith to prevent the disengagement or loosening of the closure insert and thus the leaking of container contents.

The closure insert includes a skirt and a flange. The flange is unitary with the skirt and includes top and bottom sealing surfaces which extend circumferentially about and radially outwardly from the skirt. The flange also includes a peripheral annular end sealing surface between and unitary with the top and bottom sealing surfaces. The thermoplastic material forming the container socket surrounds and is in intimate contact with the top and bottom sealing surfaces as well as the peripheral end annular sealing surface to provide a permanent seal between the closure insert and the container socket.

The flange sealing surfaces have a total actual thermoplastic material sealing area which preferably is at least about three-fourths the total apparent thermoplastic material surface area on the outer surface of the skirt of the closure insert.

The thermoplastic material of the container in contact with the flange top sealing surface may be welded thereto to further improve the seal between the closure insert and the container socket.

BRIEF DESCRIPTION OF THE DRAWINGS

In the drawings,

FIG. 1 is a perspective view of one embodiment of a container structure of the invention in its blow molded, filled and sealed configuration;

FIG. 2 is an enlarged fragmentary elevational view, partly in section, of the container closure structure of FIG. 1;

DETAILED DESCRIPTION OF THE PREFERRED EMBODIMENTS

Figure 3:
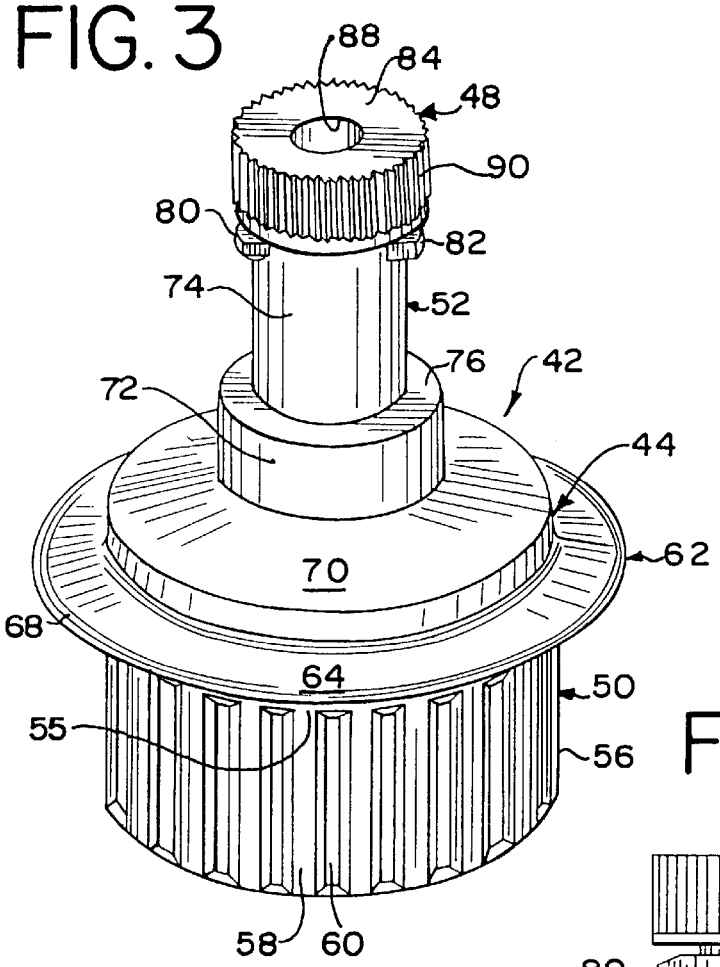
FIG. 3 is an enlarged perspective view of the closure insert subassembly of the present invention.

The invention disclosed herein is, of course, susceptible of embodiment in many different forms. Shown in the drawings and described below in detail is a preferred embodiment of the invention. It is to be understood, however, that the present disclosure is an exemplification of the principles of the invention and does not limit the invention to the illustrated embodiment.

For ease of description, the container and closure insert of the invention will be described in a normal (upright) operating position and terms such as upper, lower, horizontal, etc., will be used with reference to this position. It will be understood, however, that the container and closure insert of the present invention may be manufactured, stored, transported, used, and sold in an orientation other than the position described.

A formed, filled, and hermetically sealed, thermoplastic container 10 of the present invention is illustrated in FIGS. 1 and 2. Container 10 is preferably fabricated from conventional molding materials such as polyethylene (low or high density), polypropylene, and the like materials compatible with the contemplated container contents.

The teachings of the present invention find application in the production of filled and unfilled containers having a wide variety of shapes and sizes. Container 10 is an example of one such container and includes a hollow body portion 12 having a bottom 14 and a top 16. The container bottom 14 includes two humped end surfaces 18 and 20 and a flat surface or land 22 therebetween. A generally U-shaped support ring 24, unitary within container body portion 12, extends from the flat surface 22.

The top 16 of container body portion 12 terminates in a neck 26 unitary therewith which includes a generally cylindrical throat 28 defining a hollow passageway 30 for dispensing container contents.

Throat 28, in turn, terminates in a socket 32 unitary therewith which receives closure insert subassembly 42 and, in turn, is sealed by a closure shroud 34 which is delineated from socket 32 by a frangible web 36. Closure shroud 34 includes two spaced apart unitary and diametrically opposed wings 38 and 40.

A preformed closure insert subassembly 42 is received and immobilized within socket 32 as shown in FIG. 2.

Figure 4:
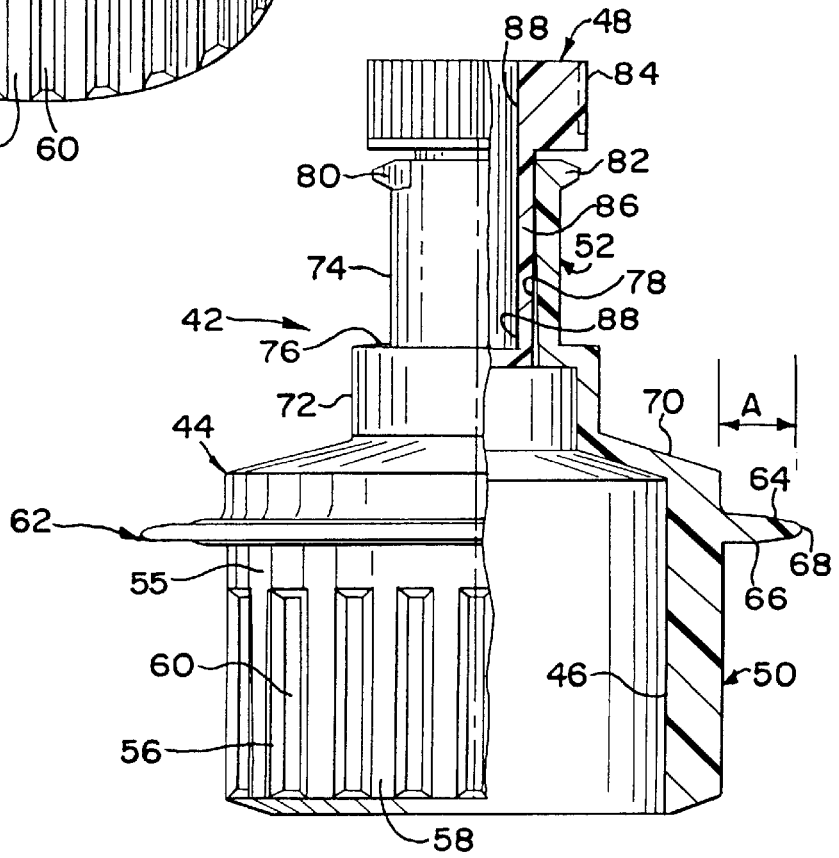
FIG. 4 is an enlarged fragmentary elevational view, partly in section, of the closure insert subassembly shown in FIG. 3.

Referring to FIGS. 3 and 4, closure insert subassembly 42 includes a hollow closure insert 44 that defines an open axial access passageway 46 to container body portion 12, and a stopper 48.

Closure insert 44 includes a cylindrical skirt or base member 50 and a unitary dispensing nozzle 52. Skirt 50 includes an outer peripheral surface 55 provided with a scabrous outer perimeter band 56 into which is molded the thermoplastic material from which container 10 as well as socket 32 are fabricated.

The scabrous outer perimeter band 56 on skirt 50 is in the form of substantially uniformly spaced ribs 58 generally parallel to the longitudinal axis of access passageway 46. The thermoplastic material of container socket 32 substantially fills the interstices or channels 60 between adjacent ribs 58 and immobilizes the closure insert 44 by forming a permanent seal between the closure insert 44 and socket 32 during molding. Moreover, the scabrous outer perimeter band 56 permits more of the thermoplastic material to be retained in the container socket 32 as the material is compressed about the insert 44 during molding. This, in turn, thickens the container wall about the insert 44 and thereby rigidifies and strengthens the socket 32 against possible dislodgement of the closure insert 44 therefrom as the container 10 is being opened in preparation for use.

The scabrous outer perimeter band 56 of closure insert 44 provides an actual contact surface area that is considerably larger than the apparent contact surface area therebetween. Preferably, the actual-to-apparent contact surface area ratio is at least about 3.

Closure insert 44 is also provided with a unitary flange 62 which extends circumferentially about and radially outwardly from the outer surface 55 of skirt 50. Flange 62 is positioned at the upper end of the skirt 50 and includes two circumferential and radially outwardly extending top and bottom sealing surfaces 64 and 66 respectively. Surfaces 64 and 66 are spaced apart from each other and converge radially outwardly into a unitary rounded peripheral end annular sealing surface 68.

As can be seen in FIG. 2, the thermoplastic material which forms container socket 32 surrounds the flange 62 and, more particularly, is disposed in intimate contact with the total actual surface area of the top and bottom sealing surfaces 64 and 66 respectively, and with the end annular sealing surface 68, so as to provide an enlarged, permanent sealing surface for container contents.

The flange 62 preferably extends away from the outer surface 55 of closure insert 44 a radial distance A which is at least about one-third the radius of skirt 50 so as to form an annular margin with top and bottom sealing surfaces and an end sealing surface. The total actual thermoplastic material sealing area so provided by the annular margin is at least about three-fourths the total apparent thermoplastic material sealing area on the outer surface 55 of skirt 50.

As illustrated in FIGS. 1 and 2, the thermoplastic material in intimate contact with the top sealing surface 64 of flange 62 includes a circumferential groove 69 which, as will be described later, is formed therein when the contiguous thermoplastic material of the container is welded to the flange 62 to further seal the closure insert 44 and the socket 32 of container 10.

Closure insert 44 also includes a boss portion 70 tapered upwardly away from the upper end of skirt 50 and merging into hollow dispensing nozzle 52 unitary with boss portion 70. Dispensing nozzle 52 extends upwardly away from the tapered boss portion 70. Nozzle 52 includes two unitary cylindrical portions 72 and 74 separated by a radially outwardly extending shoulder 76 that define additional sealing surfaces. Frangible web 36 delineates closure shroud 34 from socket 32 and circumscribes the upper end of cylindrical portion 72 of nozzle 52. Nozzle 52 defines an axial access passageway 78 in communication with axial passageway 46. Access passageway 78 can have a controlled inner diameter, i.e., a Luer™ taper for receiving Luer™ stopper 48 or a hypodermic needle. Nozzle 52 further includes two diametrically opposed lock lugs 80 and 82 extending radially outwardly from the outer surface thereof about the top open end of nozzle 52.

Stopper 48 includes a grippable cylindrical head 84 and a unitary stem 86 extending downwardly from the lower surface of head 84. A cylindrical aperture 88 extends through the head 84 and a substantial portion of stem 86 and may receive therein a rubber stopper or the like for providing a pierceable access to container contents. Head 84 is provided with a ribbed external surface 90 for enhanced grip or into which a portion of the thermoplastic material forming closure shroud 34 can be molded if desired, during the fabrication of the container 10 so that stopper 48 is in intimate contact with closure shroud 34.

To dispense the container contents, closure shroud 34 is severed and removed from the socket 32 by grasping the wings 38 and 40 of closure shroud 34 and then exerting a simultaneous twisting and lifting motion to the closure shroud 34 so as to break frangible web 36. The stopper 48 of closure insert subassembly 42 can be removed together with the closure shroud 34 when the thermoplastic material forming closure shroud 34 is molded into the ribbed surface 90 of stopper 48.

Figure 6:
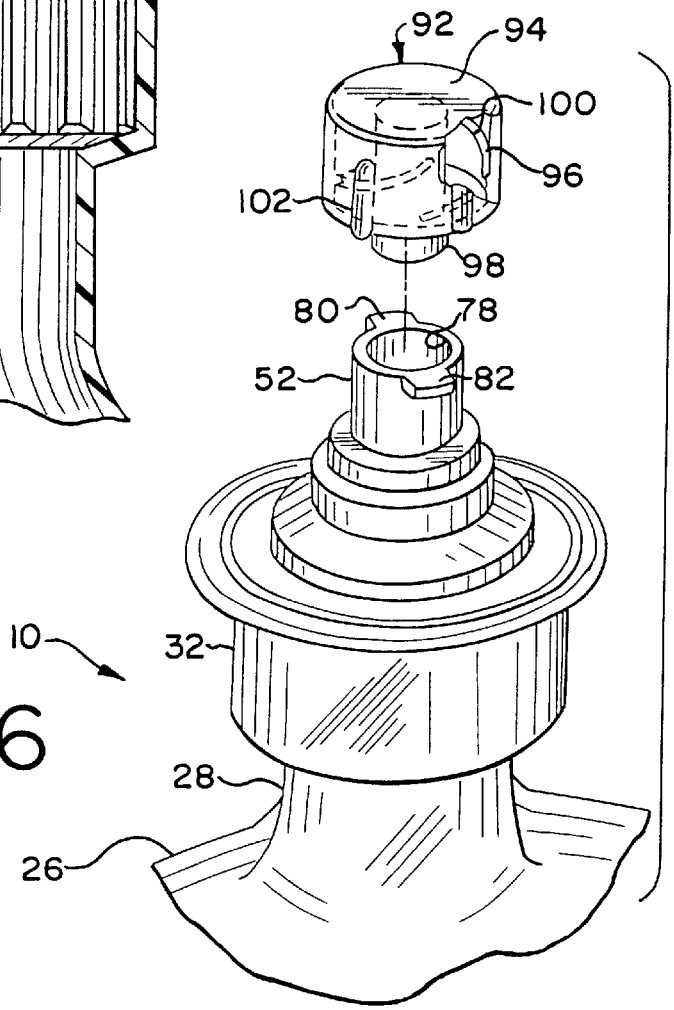
FIG. 6 is an enlarged fragmentary exploded perspective view of the container of FIG. 1 with a lock cap therefor.

If only a portion of the container contents is to be dispensed, a Luer™ cap 92 (FIG. 6) may be secured to nozzle 52 of insert 44. Cap 92 includes a flat circular top 94, a cylindrical circumferential annular wall 96 unitary with and extending downwardly from the outer periphery of top 94, and a hollow cylindrical stem 98 in the interior of cap 92 which is unitary with the top 94 and extends downwardly therefrom past the end of wall 96.

The inner surface of wall 96 includes Luer™ lock threads 100 and the outer surface thereof includes a plurality of ribs 102 dispensed generally parallel to the longitudinal axis of cap 92. The stem 98 includes a controlled diameter outer surface complementary with the controlled diameter access passageway 78 in nozzle 52.

Lugs 80 and 82 on dispensing nozzle 52 are sized to engage the Luer™ lock threads 100 of the Luer™ cap 92 and the controlled diameter access passageway 78 of nozzle 52 is adapted to receive the cylindrical stem 98 of cap 92 to secure cap 92 to nozzle 52.

Figure 5:
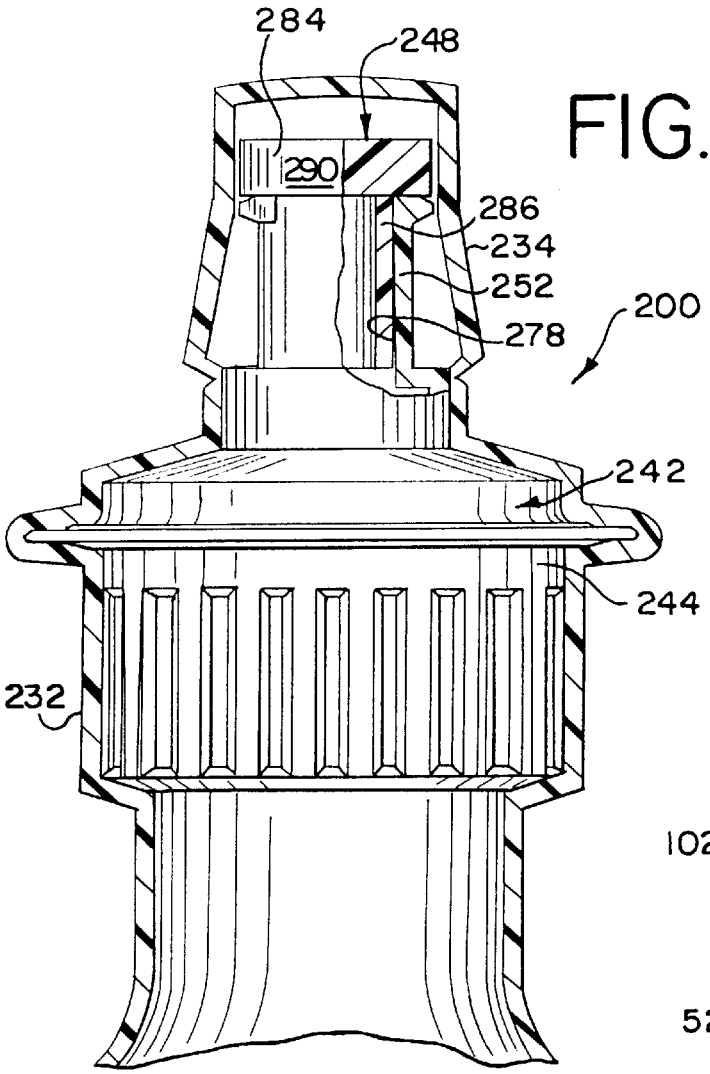
FIG. 5 is an enlarged fragmentary elevational view, partly in section, of the socket and closure shroud of a container including an alternate embodiment of a closure insert subassembly of the present invention sealed therein.

FIG. 5 illustrates an alternate container embodiment 200 including a closure insert subassembly 242 comprising a closure insert 244 similar in all respects to closure insert 44 of container 10 but including a pierceable spike cap 248, rather than a stopper 48, which remains secured within nozzle 52 while and after closure shroud 234 is severed from socket 232 to maintain access passageway 278 sealed. Spike cap 248 includes a head 284 with a flat outer surface 290. Spike cap 248 also includes a frustoconical stem 286 with a controlled diameter outer surface which frictionally engages the controlled diameter access passageway 278 in nozzle 252 so as to firmly secure spike cap 248 within nozzle 252. Moreover, and to assure that spike cap 248 remains secured to the nozzle 252 when closure shroud 234 is removed, closure shroud 234 is molded in a known manner in a hollow configuration so as to remain spaced from spike cap 248 when the container 200 is fabricated.

In this embodiment, the container contents can be dispensed by severing and removing closure shroud 234 and then piercing the spike cap 248 with a hyperdermic needle or spike or the like device.

Figure 7:
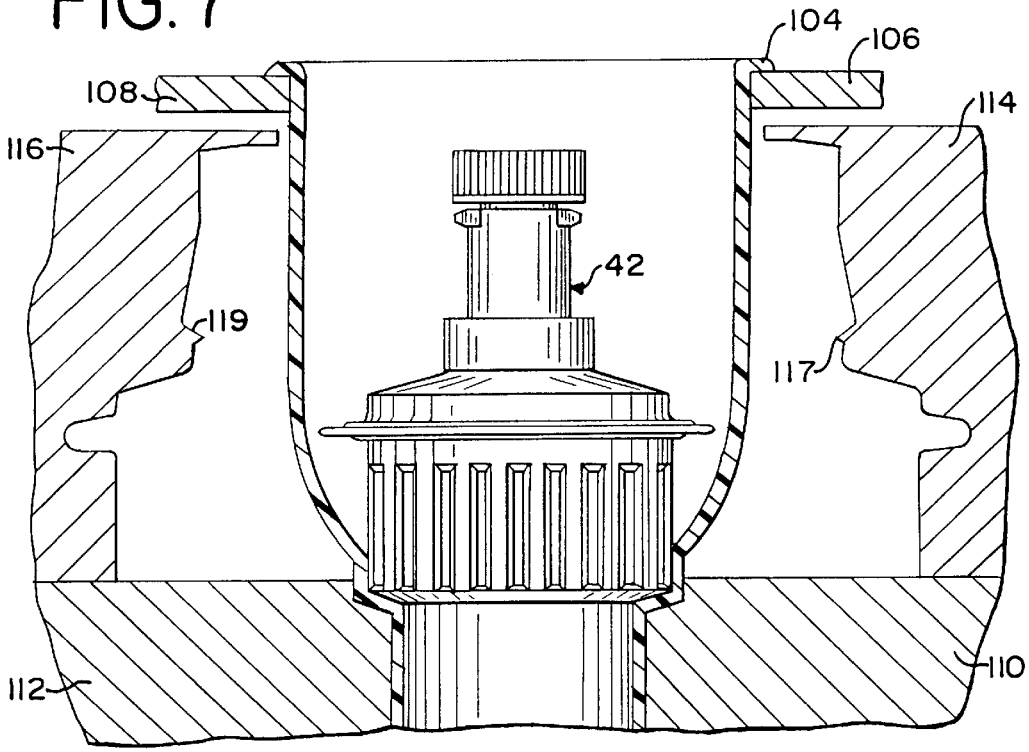
FIG. 7 is an enlarged fragmentary schematic elevational view, partly in section, generally illustrating the apparatus for molding and sealing the container, and more particularly, illustrating the closure insert subassembly in molding and sealing position within an extruded parison.
Figure 8:
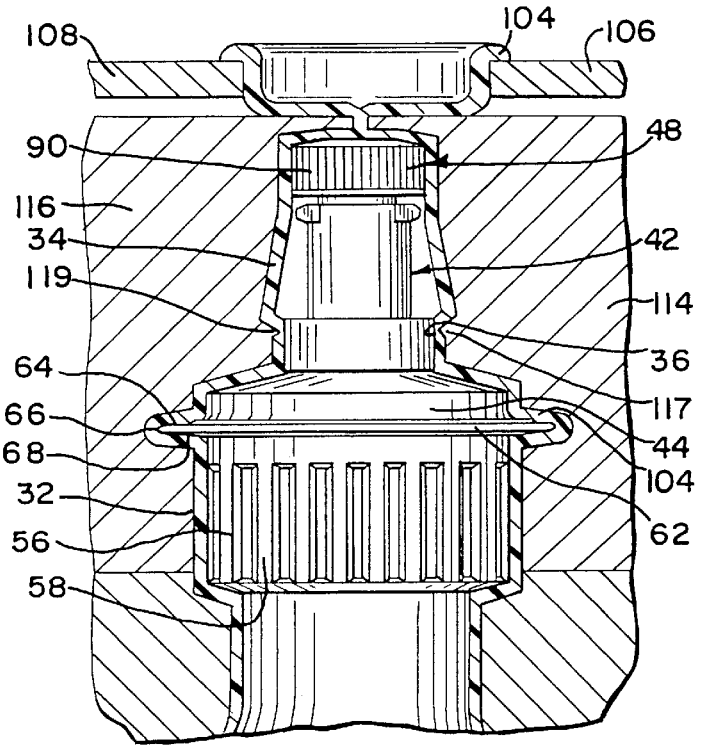
FIG. 8 is an enlarged fragmentary schematic elevational view, partly in section, similar to that of FIG. 5 but showing the parison segment fully molded and sealed about the closure insert subassembly.

The method for inserting and sealing the preformed closure insert subassembly 42 into a thermoplastic container during container fabrication is illustrated in FIGS. 7 and 8. Initially, and as shown in FIG. 7, an extruded parison segment 104 is held by vacuum assisted holding jaws 106 and 108 in position between main mold halves 110 and 112 to form and mold container body portion 12, neck 26 and throat 28 in a known manner, for example, as described in U.S. Pat. No. 4,901,873 to Weiler et al.

Thereafter, preformed closure insert subassembly 42 is positioned as shown in FIG. 7. Next, sealing mold halves 114 and 116 are moved inwardly toward one another (FIG. 8) to compress the remaining, upper parison portion about closure insert subassembly 42 so as to form socket 32 as well as closure shroud 34 while urging the thermoplastic material of the parison into the interstices between adjacent longitudinal ribs 58 of scabrous outer perimeter band 56 of closure insert 44, into intimate contact with the total contact area of the top and bottom sealing surfaces 64 and 66 and peripheral end sealing surface 68 of flange 62, and into the ribbed external surface 90 of stopper 48. Each of the sealing mold halves 114 and 116 includes a knife edge 117 and 119 respectively for forming the frangible web 36 between socket 32 and closure shroud 34.

In this manner, the scabrous outer perimeter band 56 and flange 62 effectively and expeditiously permanently secure and seal closure insert subassembly 42 within socket 32 of container 10.

To further improve the seal between the closure insert subassembly 42 and socket 32, the thermoplastic material overlying and in intimate contact with the top sealing surface 64 of flange 62 may be welded to flange surface 64. Any suitable type of welding technique may be utilized including, but not limited to, ultrasonic, heat, and radio frequency (RF) welding techniques.

The groove 69 illustrated in FIGS. 1 and 2 was formed in the thermoplastic material as a result of the use of an ultrasonic welding gun with a cylindrical welding head. It is understood, however, that any other suitable type of welding device may be utilized.

Although not illustrated, it is also understood that the thermoplastic material in intimate contact with the bottom sealing surface 66 and the peripheral end sealing surface 68 of flange 62 can likewise be welded to the flange surface 66 and peripheral end sealing surface 68 respectively for an enhanced seal.

The closure inserts contemplated by the present invention are prefabricated, for example by injection molding, and can have a wide variety of dispensing configurations depending upon contemplated end use. Single piece inserts as well as subassemblies are contemplated. However, in all instances the closure insert is provided with a flange that provides an increased surface area for intimate contact with the thermoplastic container material during molding to provide a permanent sealing surface for the container contents.

I claim:

1. A hermetically sealed container of a thermoplastic material and comprising:

(a) a body portion;

(b) a socket unitary with said body portion;

(c) a preformed closure insert within said socket and defining an axial access passageway into said body portion, said passageway having a longitudinal axis, said closure insert including a skirt with a scabrous outer perimeter band and an outwardly extending peripheral flange defining a top sealing surface, said scabrous outer perimeter band having substantially uniformly spaced ribs generally parallel to said longitudinal axis and defining channels between said ribs, said skirt being immobilized within said socket, said flange being welded at the top sealing surface thereof to the container and together with said scabrous outer perimeter band providing a permanent seal for container contents; and (d) a removable closure shroud unitary with said socket and delineated therefrom by a peripheral frangible web circumscribing said closure insert.

2. The container of claim 1 wherein the thermoplastic material forming the socket of the container substantially fills said channels of said scabrous outer perimeter band and provides a permanent seal for container contents.

3. The container of claim 1 wherein said skirt includes an outer surface, said flange is unitary with said skirt, extends circumferentially about and radially outwardly from said outer surface, and includes top and bottom circumferentially and radially outwardly extending sealing surfaces, and said thermoplastic material forming said socket is in intimate contact with said top and bottom sealing surfaces and provides a permanent seal for container contents.

4. The container of claim 3 wherein said scabrous outer perimeter band defines an apparent surface sealing area and said top and bottom sealing surfaces of said flange have a total actual surface sealing area which is about three-fourths the apparent surface sealing area.

5. The container of claim 1 wherein said skirt includes an outer surface, said flange is unitary with said skirt, extends circumferentially about and radially outwardly from said outer surface, and includes top and bottom circumferentially and radially outwardly extending sealing surfaces and a peripheral annular end sealing surface therebetween and unitary therewith; said top and bottom sealing surfaces being spaced apart from each other and converging radially outwardly into said peripheral annular end sealing surface, said thermoplastic material forming said socket of said container being in intimate contact with said top and bottom sealing surfaces and with said peripheral annular end sealing surface to provide a permanent seal for container contents.

6. The container of claim 5 wherein said peripheral annular end surface is rounded.

7. The container of claim 1 wherein said skirt includes an outer surface, said flange is unitary with said skirt, extends circumferentially about and radially outwardly from said outer surface, and includes top and bottom circumferentially and radially outwardly extending sealing surfaces, and said thermoplastic material forming said socket being welded to said top surface of said flange to provide a permanent seal for container contents.

8. The container of claim 1 wherein said closure insert is a subassembly including a dispensing nozzle unitary with said skirt and a stopper removably received in said dispensing nozzle for closing said axial access passageway defined by said closure insert.

9. The container of claim 8 wherein the thermoplastic material forming said removable closure shroud of said container is in intimate contact with said stopper of said closure insert.

10. The container of claim 1 wherein said closure insert is a subassembly including a dispensing nozzle unitary with said skirt and a spike cap secured in said dispensing nozzle for closing said axial passageway defined by said closure insert.

11. The container of claim 10 wherein said removable closure shroud is hollow and is spaced from said closure insert and said spike cap.

12. The container of claim 1 wherein said skirt is cylindrical, and said flange on said closure insert extends away from said skirt a radial distance which is at least about one-third the radius of said skirt.

13. The container of claim 1 wherein said scabrous outer perimeter band has an apparent surface sealing area and said flange on said closure insert has an actual surface sealing area which is about three-fourths the apparent surface sealing area.

14. The container of claim 1 wherein the thermoplastic material is ultrasonically welded to the top sealing surface of said flange.

15. The container of claim 1 wherein the thermoplastic material is radio frequency welded to the top sealing surface of said flange.

16. The container of claim 1 wherein the thermoplastic material is heat welded to said flange.

17. The container of claim 1 wherein said skirt includes an outer surface, said flange is unitary with said skirt and extends circumferentially about and radially outwardly from said outer surface, and includes top and bottom circumferentially and radially outwardly extending sealing surfaces; the thermoplastic material of said socket being welded to said top sealing surface to provide a permanent seal for container contents.

18. The container of claim 1 wherein said skirt includes an outer surface, said flange is unitary with said skirt and extends circumferentially about and radially outwardly from the outer surface, and includes top and bottom circumferentially and radially outwardly extending sealing surfaces and a peripheral annular end sealing surface therebetween and unitary therewith; said top and bottom sealing surfaces being spaced apart from each other and converging radially outwardly into said peripheral annular end sealing surface, and said thermoplastic material forming said socket being welded to said top and bottom sealing surfaces and said peripheral annular end sealing surface to provide a permanent seal for container contents.

* * * * *